US005176160A

United States Patent [19]

Osborn

[11] Patent Number: 5,176,160

[45] Date of Patent: Jan. 5, 1993

[54] COMBINATION CANE AND REACHING APPARATUS

[76] Inventor: George M. Osborn, 275 Center St., San Rafael, Calif. 94901

[21] Appl. No.: 895,103

[22] Filed: Jun. 8, 1992

[51] Int. Cl.[5] ..... A45B 3/00

[52] U.S. Cl. ..... 135/66; 135/70

[58] Field of Search ..... 135/65, 66, 70, 68

[56] References Cited

U.S. PATENT DOCUMENTS

| | | | |
|---|---|---|---|
| 2,346,038 | 4/1944 | Mason | 135/66 X |
| 3,448,749 | 6/1969 | Stark | 135/70 X |
| 4,299,246 | 11/1981 | Marsh | 135/66 |
| 4,434,808 | 3/1984 | Burak | 135/70 X |
| 4,811,750 | 3/1989 | McAllister | 135/66 |
| 4,827,956 | 5/1989 | Toot | 135/66 |
| 4,977,914 | 12/1990 | Smerker | 135/70 X |

FOREIGN PATENT DOCUMENTS

| | | | |
|---|---|---|---|
| 511590 | 10/1930 | Fed. Rep. of Germany | 135/66 |
| 3546243 | 7/1986 | Fed. Rep. of Germany | 135/65 |
| 2578401 | 9/1986 | France | 135/66 |
| 2122077 | 1/1984 | United Kingdom | 135/66 |
| 2209934 | 6/1989 | United Kingdom | 135/66 |

*Primary Examiner*—Richard E. Chilcot, Jr.
*Assistant Examiner*—Lan Mai
*Attorney, Agent, or Firm*—Larry D. Johnson

[57] ABSTRACT

A combination cane and reaching apparatus includes a cane body having a longitudinal axis and terminating in a pair of ends, a top end having a handle member including a grip portion extending in a direction generally perpendicular to the cane body longitudinal axis, and a bottom end terminating in a cane tip. A trigger portion is secured to the cane body proximate the handle member, and includes a trigger element and a trigger pivot axis. A jaw portion is secured to the cane body proximate the cane tip, and includes a jaw element, a jaw pivot axis, and a spring. A string capture or lock portion is attached to the cane body between the trigger portion and jaw portion. A cable or string segment connects the trigger element and jaw element, with the string segment bearing a bead or knot along its length proximate the string lock portion.

6 Claims, 2 Drawing Sheets

COMBINATION CANE AND REACHING APPARATUS

BACKGROUND OF THE INVENTION

1. Field of the Invention

This invention relates generally to canes and other articles, and more specifically to an improved combination cane and reaching apparatus.

2. Description of the Prior Art

Canes, crutches, and other walking aids are well known and in widespread use. Reaching or grasping tools (commonly called "reachers") are also well known, and typically consist of an elongate member with a remotely actuable jaw to capture or lift various articles. Combination cane and reaching tools have been developed, and may be used by a person who has temporarily or permanently limited movement of the feet, ankles, legs, knees, hips or back. Such a person may be able to walk with a cane but has difficulty in bending down to pick up or move anything from the floor, ground or knee level. However, known cane-reacher combinations are heavy, complicated mechanisms, and are difficult for the user to manipulate.

SUMMARY OF THE INVENTION

The combination cane and reaching apparatus of this invention provides an improved walking aid that simultaneously permits the user to grasp and lift various articles. The inventive apparatus includes a cane body having a longitudinal axis and terminating in a pair of ends, a top end having a handle member including a grip portion extending in a direction generally perpendicular to the cane body longitudinal axis, and a bottom end terminating in a cane tip. A trigger portion is secured to the cane body proximate the handle member, and includes a trigger element and a trigger pivot axis. A jaw portion is secured to the cane body proximate the cane tip, and includes a jaw element, a jaw pivot axis, and a spring. A string capture or lock portion is attached to the cane body between the trigger portion and jaw portion, or may be a part of the trigger portion being placed at its lower end, not being a separate portion at all. A cable or string segment connects the trigger element and jaw element, with the string segment bearing a bead or knot along its length proximate the string lock portion.

In operation, the user squeezes the trigger element to move it about the trigger axis, which retracts the string to move the jaw element about the jaw pivot axis and against the cane tip, thus closing the jaw to grasp an object. Normally, the spring urges the jaw to return to the open position after each closure (all in the traditional reacher function). However, when the trigger is retracted and the jaw closed, the string may be slightly displaced from linearity so that the bead is captured by the string capture portion and held there by the spring tension, thereby maintaining the jaw in its closed configuration. This prevents damage to the jaw element, and renders the apparatus more compact and less awkward. The bead may be subsequently released and the string returned to linearity (so that the jaw may be correspondingly opened) by a slight retraction of the trigger, and the reacher used as desired.

The combination cane and reaching apparatus of this invention may be manufactured as a unit, incorporating an appropriately-designed cane (e.g., light in weight, a tapered shaft for balance, a smaller cane tip for dexterity, and a good grip for control). Alternatively, the reacher components could be sold separately and retrofit to any existing cane.

DETAILED DESCRIPTION OF A PREFERRED EMBODIMENT

Figure 1:
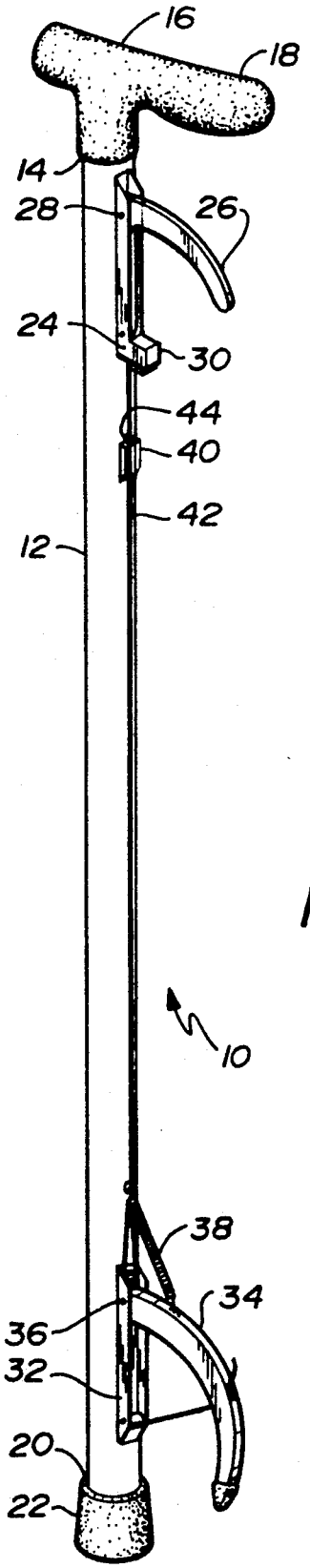
FIG. 1 is a perspective view of the combination cane and reaching apparatus of this invention illustrating the components of the apparatus, including a cane body having a longitudinal axis and terminating in a pair of ends, a top end having a handle member including a grip portion extending in a first direction generally perpendicular to said cane longitudinal axis, and a bottom end terminating in a cane tip; a trigger portion secured to the cane body proximate said handle member, said trigger portion including a trigger element, a trigger pivot axis, and a cane rest; a jaw portion secured to said cane body proximate said cane tip, said jaw portion including a jaw element, a jaw pivot axis, and a spring; a string capture or lock portion attached to said cane body between said trigger portion and jaw portion; and a cable or string segment connecting said trigger element and jaw element, said string segment bearing a bead or knot along its length proximate said string lock portion.

FIG. 1 is a perspective view of the combination cane and reaching apparatus 10 of this invention illustrating the components of the apparatus. The apparatus includes a cane body 12 having a longitudinal axis and terminating in a pair of ends, a top end 14 having a handle member 16 including a grip portion 18 extending in a first direction generally perpendicular to the cane body longitudinal axis, and a bottom end 20 terminating in a cane tip 22. A trigger portion 24 is secured to the cane body 12 proximate the handle member 16, and includes a trigger element 26, a trigger pivot axis 28, and a cane rest 30. A jaw portion 32 is secured to the cane body 12 proximate the cane tip 22, and includes a jaw element 34, a jaw pivot axis 36, and a spring 38. A string capture or lock portion 40 is attached to the cane body 12 between the trigger portion 24 and jaw portion 32, or may be a part of the trigger portion being placed at its lower end, not being a separate portion at all. A cable or string segment 42 connects the trigger element 26 and jaw element 34, and bears a bead or knot 44 along its length proximate the string lock portion 40.

Combination cane and reaching apparatus 10 may be originally and permanently manufactured to incorporate all of the elements of this invention, or may alternatively be made from the combination of a more or less standard cane to which the operative elements of a reacher device have been added, along with a string lock portion, cane rest, and/or handle grip, as appropriate. For example, trigger portion 24 and jaw portion 32 may be adapted from a well known reacher device and temporarily or permanently secured to the cane body by screws, adhesive, clamps, tie straps, or any other appropriate fastening means. Cane body 12 could even comprise an adjustable-length cane, with the string length adjustable as described infra.

The cane rest 30 may consist of a projection extending from the upper part of the cane body with a tab of non-skid material on its bottom side. The cane rest enables the user to rest the cane on a table or counter edge rather than leaving the cane against a verticle surface where it can fall down when the user needs both hands for other purposes or when the cane is not being used.

Figure 2:
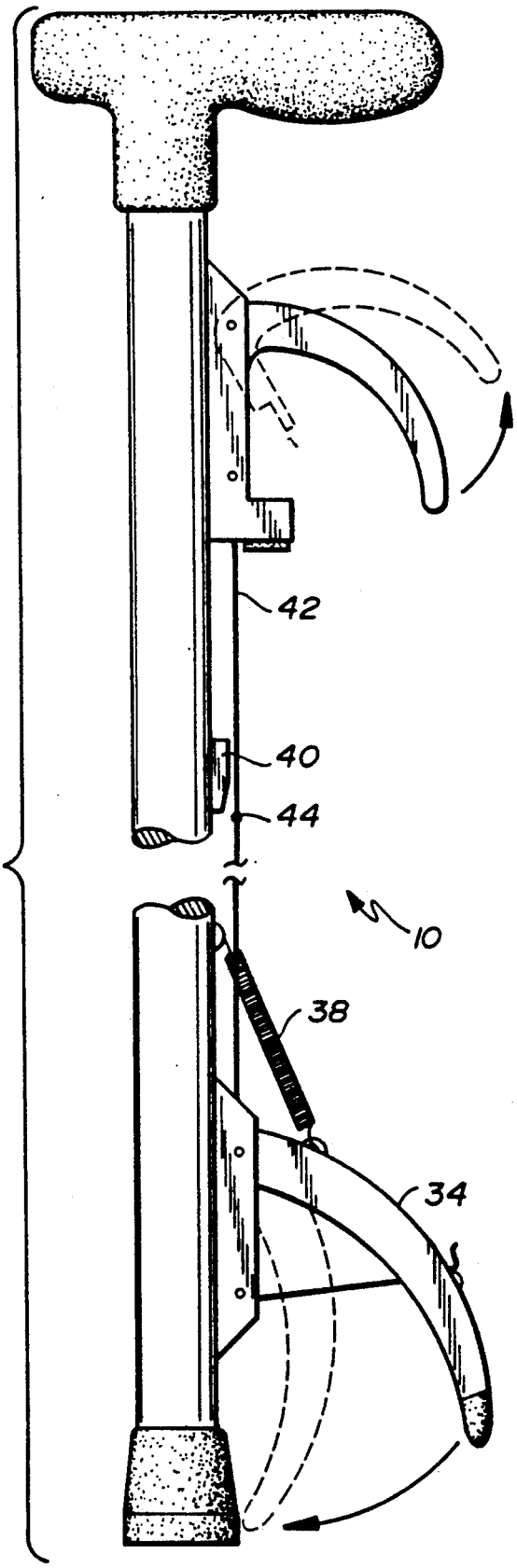
FIG. 2 is a shortened side elevation view of the combination cane and reaching apparatus of this invention illustrating the apparatus in its open jaw position (with the closed jaw position shown in phantom)

FIG. 2 is a shortened side elevation view of the combination cane and reaching apparatus 10 of this invention illustrating the apparatus in its open jaw position (with the closed jaw position shown in phantom). This view illustrates string bead 44 released from the string lock portion 40, thereby enabling jaw element 34 to be opened by spring 38.

Figure 3:
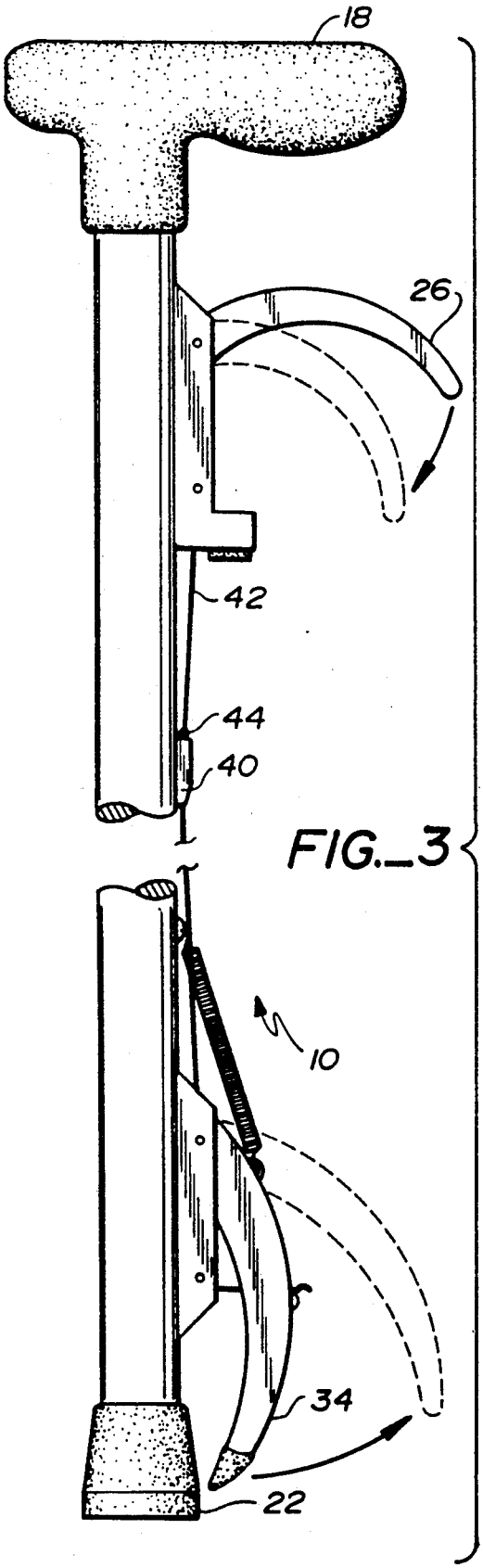
FIG. 3 is a shortened side elevation view of the combination cane and reaching apparatus of this invention illustrating the apparatus in its closed jaw position (with the open jaw position shown in phantom)

FIG. 3 is a shortened side elevation view of the combination cane and reaching apparatus 10 of this invention illustrating the apparatus in its closed jaw position (with the open jaw position shown in phantom). This view illustrates bead 44 captured by string lock portion 40, such that jaw element 34 is closed against cane tip 22, and trigger element 26 is retracted towards grip portion 18. This view further illustrates the desired offset between the end of jaw element 34 and the base of cane tip 22. It is desirable to maintain this slight offset (e.g., one-eighth inch) so that the jaw element does not interfere with the ground or an object when the assembly is being used purely as a cane. This offset may be maintained, even after wearing down of the cane tip, by adding washers or other spacers beneath the tip, or replacing the tip as necessary.

Figure 4:
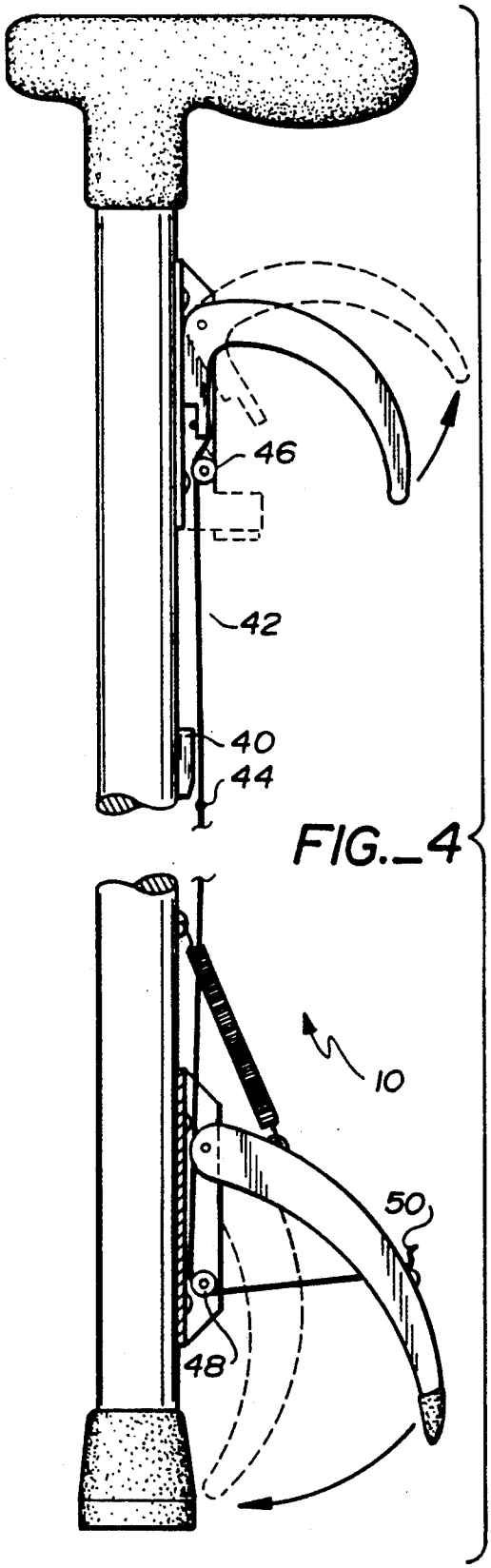
FIG. 4 is a shortened side elevation view of the combination cane and reaching apparatus of this invention illustrating the string path from the trigger portion to the jaw portion.

FIG. 4 is a shortened side elevation view of the combination cane and reaching apparatus 10 of this invention illustrating the string path from the trigger portion to the jaw portion. The string is preferably secured to trigger element 26, passes over trigger portion string pulley 46, past string lock 40 to jaw portion string pulley 48, to jaw element 34 at adjustable fastener 50. This adjustable fastener (such as a screw) enables the length of the string to be readily adjusted, making these reacher components ideally suited for retrofit installation on a variety of canes and cane lengths, or even to an adjustable-length cane. In addition, the string bead or knot 44 may itself be an adjustable device, such as a small, securable clamp, such that it may be properly positioned anywhere along the length of the string to permit the desired capture by the string lock portion.

While this invention has been described in connection with preferred embodiments thereof, it is obvious that modifications and changes therein may be made by those skilled in the art to which it pertains without departing from the spirit and scope of the invention. For example, several components (e.g., the end of the jaw element, the sides of the cane tip, and the base of the cane rest) could be covered with a non-skid coating to increase frictional engagement. Furthermore, alternative spring arrangements such as a torsion spring could be utilized to accomplish the desired jaw opening. Also, a ball chain segment could be substituted for part or all of the string segment, such that the ball chain could be readily captured by a complementary receiver in the string lock portion. Accordingly, the scope of this invention is to be limited only by the appended claims.

What is claimed as invention is:

1. A combination cane and reaching apparatus comprising:

a cane member having a longitudinal axis and pair of ends, a first end including a grip portion extending in a first direction generally perpendicular to said cane member longitudinal axis, and a second end bearing a cane tip;

a trigger portion secured to said cane member proximate said grip portion and extending from said cane member in said first direction;

a jaw portion secured to said cane member proximate said cane tip, said jaw portion extending from said cane member in said first direction;

a string lock portion secured to said cane member between said trigger portion and said jaw portion, said string lock portion extending from said cane member in said first direction; and a string segment connecting said trigger portion and said jaw portion, said string segment bearing a bead portion for releasable capture by said string lock portion.

2. The combination cane and reaching apparatus of claim 1 wherein said jaw portion has a length, said length terminating before said cane tip.

3. The combination cane and reaching apparatus of claim 1 wherein capture of said bead portion by said string lock portion closes said jaw portion against said cane tip.

4. The combination cane and reaching apparatus of claim 1 further including a spring to normally open said jaw portion.

5. The combination cane and reaching apparatus of claim 1 further including a cane rest tab portion.

6. The combination cane and reaching apparatus of claim 1 wherein said trigger portion, said jaw portion, and string lock portion are secured to a cane member by releasable straps.

* * * * *